US008066412B2

(12) United States Patent
Vann et al.

(10) Patent No.: US 8,066,412 B2
(45) Date of Patent: Nov. 29, 2011

(54) LUMINAIRE QUICK MOUNT UNIVERSAL BRACKET SYSTEM AND METHOD

(75) Inventors: Steen Vann, Morrow, GA (US); Sun Yuan Wei, Shanghai (CN)

(73) Assignee: Cooper Technologies Company, Houston, TX (US)

( * ) Notice: Subject to any disclaimer, the term of this patent is extended or adjusted under 35 U.S.C. 154(b) by 412 days.

(21) Appl. No.: 12/215,843

(22) Filed: Jun. 30, 2008

(65) Prior Publication Data

US 2009/0321598 A1 Dec. 31, 2009

(51) Int. Cl.
*F21V 15/01* (2006.01)

(52) U.S. Cl. ..... 362/362; 362/368; 362/370; 362/371; 362/374; 248/342

(58) Field of Classification Search ..... 362/362, 362/368, 369, 370, 371, 374, 375; 248/342–344, 248/906

See application file for complete search history.

(56) References Cited

U.S. PATENT DOCUMENTS

| | | | | |
|---|---|---|---|---|
| 3,030,497 | A | 4/1962 | Cheng | |
| 3,297,865 | A * | 1/1967 | Baldwin | 362/347 |
| 4,525,391 | A | 6/1985 | Eckberg | |
| 4,535,391 | A | 8/1985 | Hsiao | |
| 4,839,783 | A * | 6/1989 | Arai | 362/374 |
| 5,045,984 | A * | 9/1991 | Trowbridge et al. | 362/365 |
| 5,121,309 | A * | 6/1992 | Ewing et al. | 362/652 |
| 5,428,897 | A | 7/1995 | Jordan et al. | |
| 5,850,999 | A * | 12/1998 | Gross | 248/342 |
| 6,276,818 | B1 * | 8/2001 | Wang | 362/374 |
| 6,293,510 | B1 * | 9/2001 | Bradford et al. | 248/317 |
| 6,606,808 | B2 | 8/2003 | Katz | |
| 7,121,684 | B2 | 10/2006 | Barozzini et al. | |
| 7,175,313 | B2 | 2/2007 | Bednara et al. | |
| D551,795 | S | 9/2007 | Compton et al. | |
| 2004/0080938 | A1 | 4/2004 | Holman et al. | |
| 2007/0206384 | A1 | 9/2007 | Compton et al. | |
| 2009/0129101 | A1 * | 5/2009 | Bowden et al. | 362/371 |
| 2009/0310330 | A1 | 12/2009 | Vann | |

FOREIGN PATENT DOCUMENTS

| | | | |
|---|---|---|---|
| JP | 402078104 A | * | 3/1990 |
| WO | WO 84/01013 | * | 3/1984 |

* cited by examiner

*Primary Examiner* — James Lee
*Assistant Examiner* — Stanley Weinberg
(74) *Attorney, Agent, or Firm* — King & Spalding LLP

(57) ABSTRACT

A luminaire system provides for mounting and accessing a light fixture housing without tools. A universal bracket is coupled to the junction box along the ceiling and engages with a top mounting plate affixed to the housing. One or more slide hooks appended to the universal bracket allows the top mounting plate to mount to the universal bracket, and a reinforced spring and locking spring keeps the light fixture housing in place, while preventing rattling between the universal bracket and the top-mounting plate. The housing can be removed from the electrical junction box through the use of a release button affixed to the housing. The button disengages the locking spring from the top mounting plate, thereby allowing the housing to swivel away from the universal bracket and junction box by way of a hanging hook. The hanging hook supports the housing when released from the universal bracket.

15 Claims, 8 Drawing Sheets

LUMINAIRE QUICK MOUNT UNIVERSAL BRACKET SYSTEM AND METHOD

TECHNICAL FIELD

The invention relates generally to light fixtures and more particularly to a universal bracket system for mounting, securing, and accessing components of a light fixture.

BACKGROUND

A luminaire is a system for producing, controlling, and/or distributing light for illumination. For example, a luminaire can include a system that outputs or distributes light into an environment, thereby allowing certain items in that environment to be visible. Luminaires are sometimes referred to as "light fixtures."

A luminaire may be attached or suspended from an overhead location, such as a ceiling. A typical luminaire includes electrical components contained within a housing, a lamp socket coupled to the electrical components and a reflector or diffuser mounted to the lamp housing. For suspended luminaries, one or more cables connecting the housing to an overhead location can also be included. The lamp socket is configured to receive a light-emitting element, such as a lamp, a light-emitting diode ("LED"), or a bulb.

A person must be able to access the internal electrical components of the light fixture to perform routine maintenance on the light fixture and/or to troubleshoot failures of the light fixture. For example, access to the internal electrical components may be necessary to replace a faulty electrical component with a working electrical component. To access the internal electrical components in the housing of a conventional light fixture, a person has to climb a ladder or ride a bucket truck to the overhead location of the light fixture and disconnect the housing from the overhead location. The housing is typically affixed to a junction box by one or more screws or bolts. Once the light fixture is removed, the electrical components of the housing can be accessed. This process, however, is time consuming and cumbersome. In addition, this process is dangerous because the person could accidentally drop the housing from the overhead location while disconnecting it and/or accessing the electrical components. Further, because conventional light fixtures are attached to the housing through the use of screws and/or bolts, the fixtures have a tendency to rattle during periods of vibration. This rattling may cause unnecessary noise and ultimate failure of the components of the light fixture.

Accordingly, a need exists in the art for an improved means for quickly mounting, securing, and accessing components of a light fixture, while also providing a fixture that is less prone to rattling.

SUMMARY

The luminaire quick-mount universal bracket system allows for quickly mounting, securing, and accessing components of a light fixture without the use of tools, while also helping to prevent rattling of the fixture. The luminaire system can include a housing, a universal bracket, and a hanging hook. The hanging hook can attach to the housing and the universal bracket, so that the housing swivels away from the universal bracket without the risk of the housing being dropped. The universal bracket can be connected to a junction box or other desirable location. The universal bracket can include a locking spring for securing the housing in place and a reinforced spring for applying tension to the housing to help prevent rattling. The housing can include a button or other release mechanism that allows the housing to be released from the universal bracket without the need for a tool.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWING

For a more complete understanding of the present invention and the advantages thereof, reference is now made to the following description, in conjunction with the accompanying figures briefly described as follows.

DETAILED DESCRIPTION OF THE EXEMPLARY EMBODIMENTS

A quick-mount universal bracket system includes a housing and a universal bracket. The housing and universal bracket are connected to one another by a hanging hook, which allows the housing to rotate away from the universal bracket while still being safely attached thereto. The inventive functionality of the quick-mount universal bracket system will be explained in more detail in the following description an is disclosed in conjunction with the presented figures.

Figure 1:
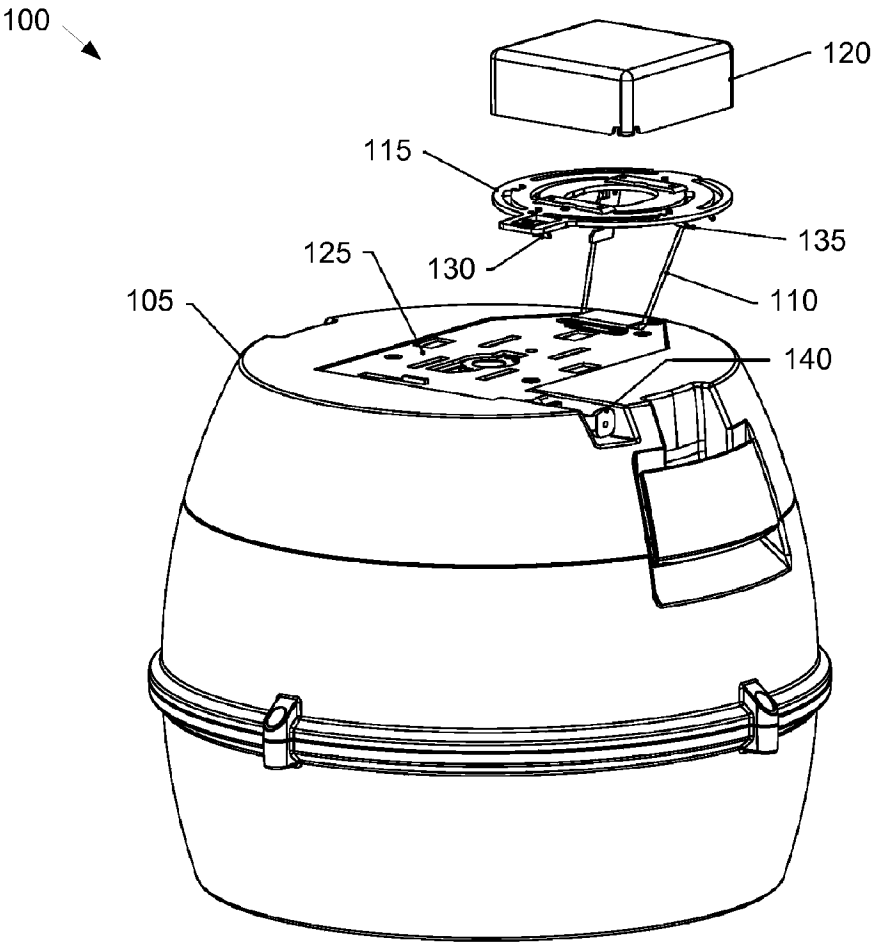
FIG. 1 is a perspective partially exploded view of a luminaire system using a quick-mount universal bracket, according to an exemplary embodiment of the invention.
Figure 2:
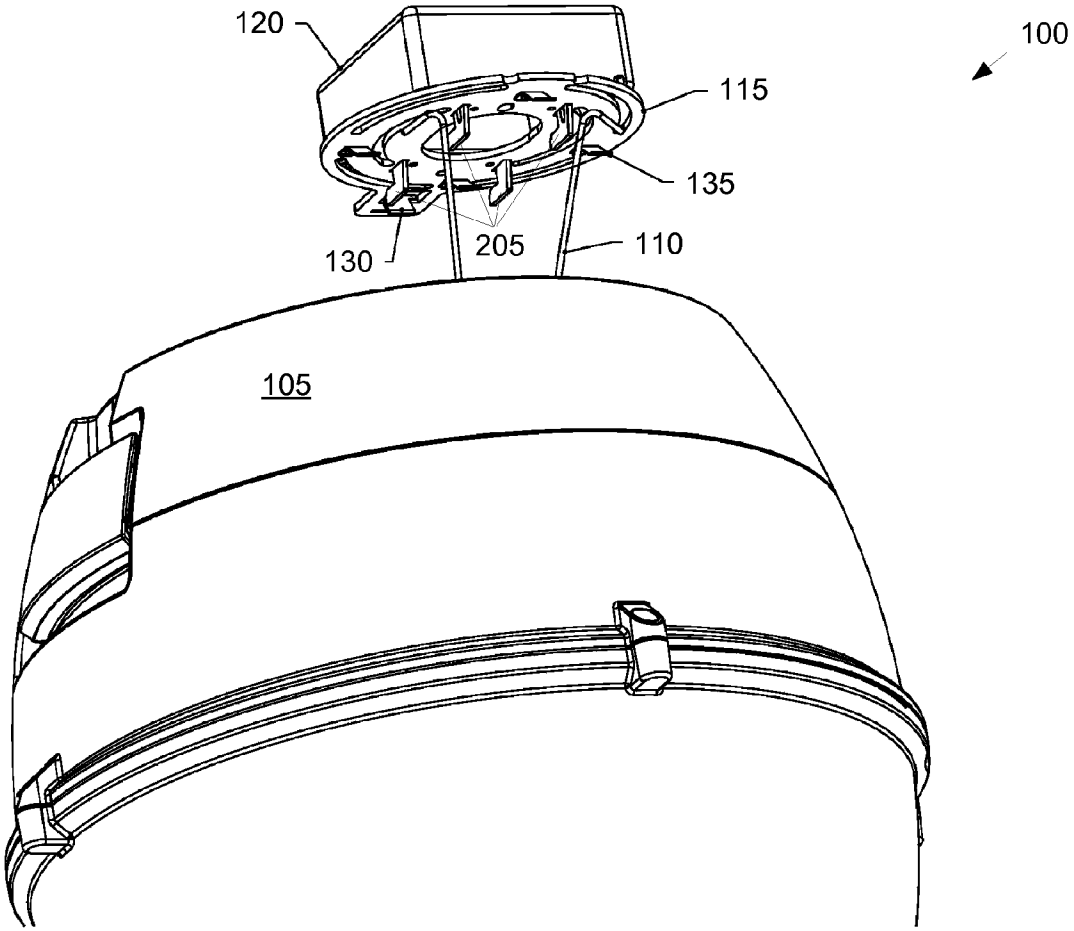
FIG. 2 is a partial perspective view of the luminaire system of FIG. 1 using the quick-mount universal bracket, according to an exemplary embodiment of the invention.
Figure 3:
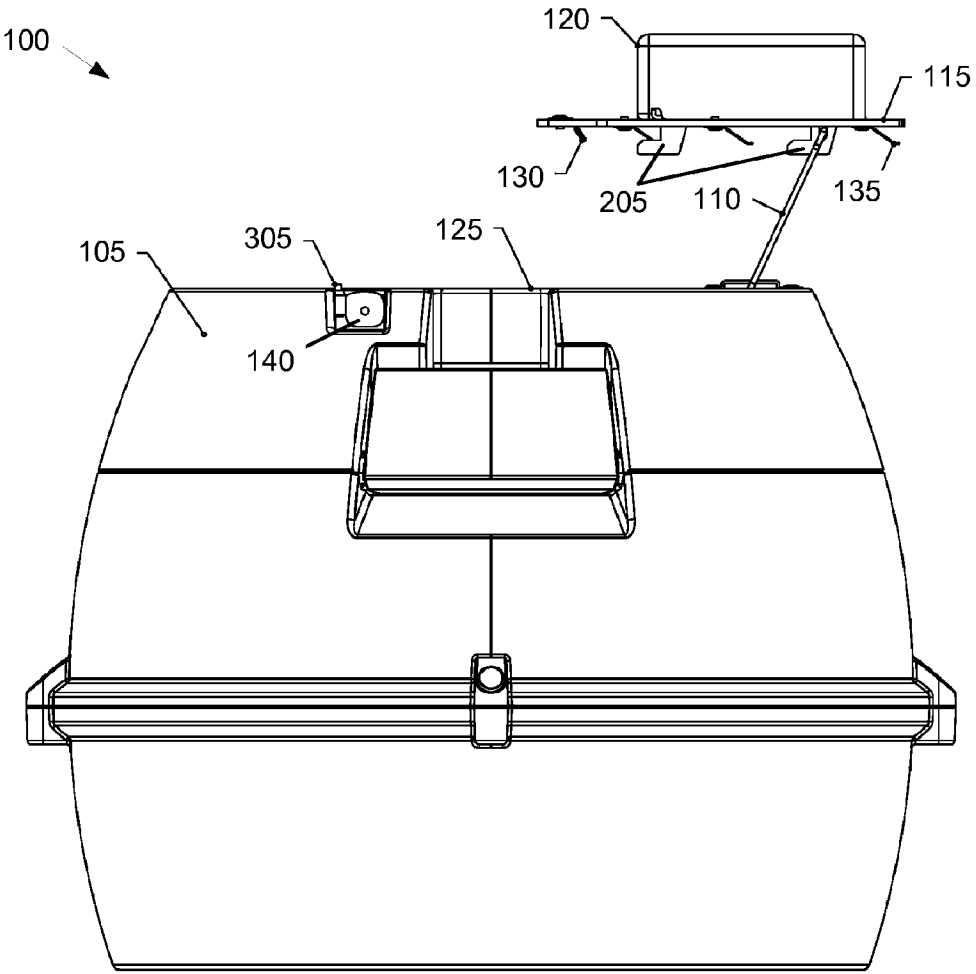
FIG. 3 is an elevation view of the quick-mount universal bracket system of FIG. 1, according to an exemplary embodiment of the invention.
Figure 4:
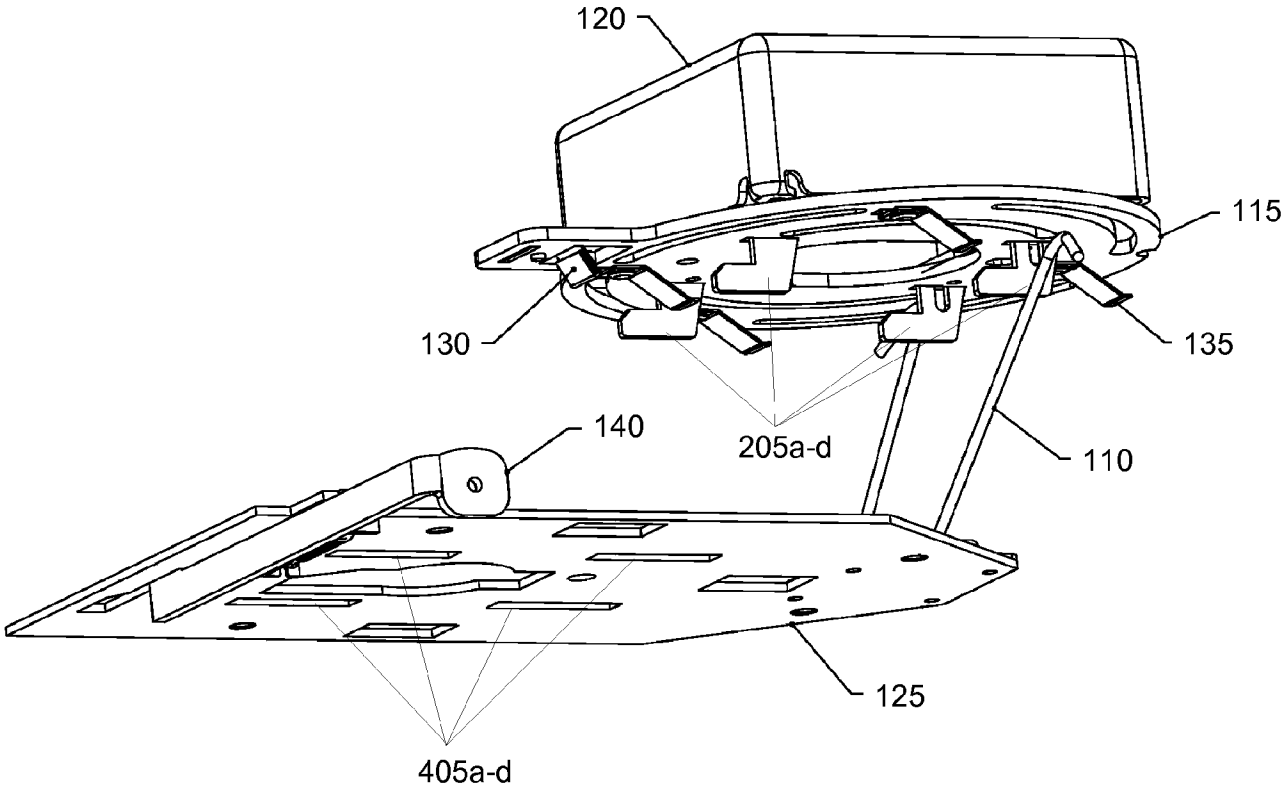
FIG. 4 is a prospective view of the interplay of the universal bracket and a top mounting plate, according to an exemplary embodiment of the invention.
Figure 5:
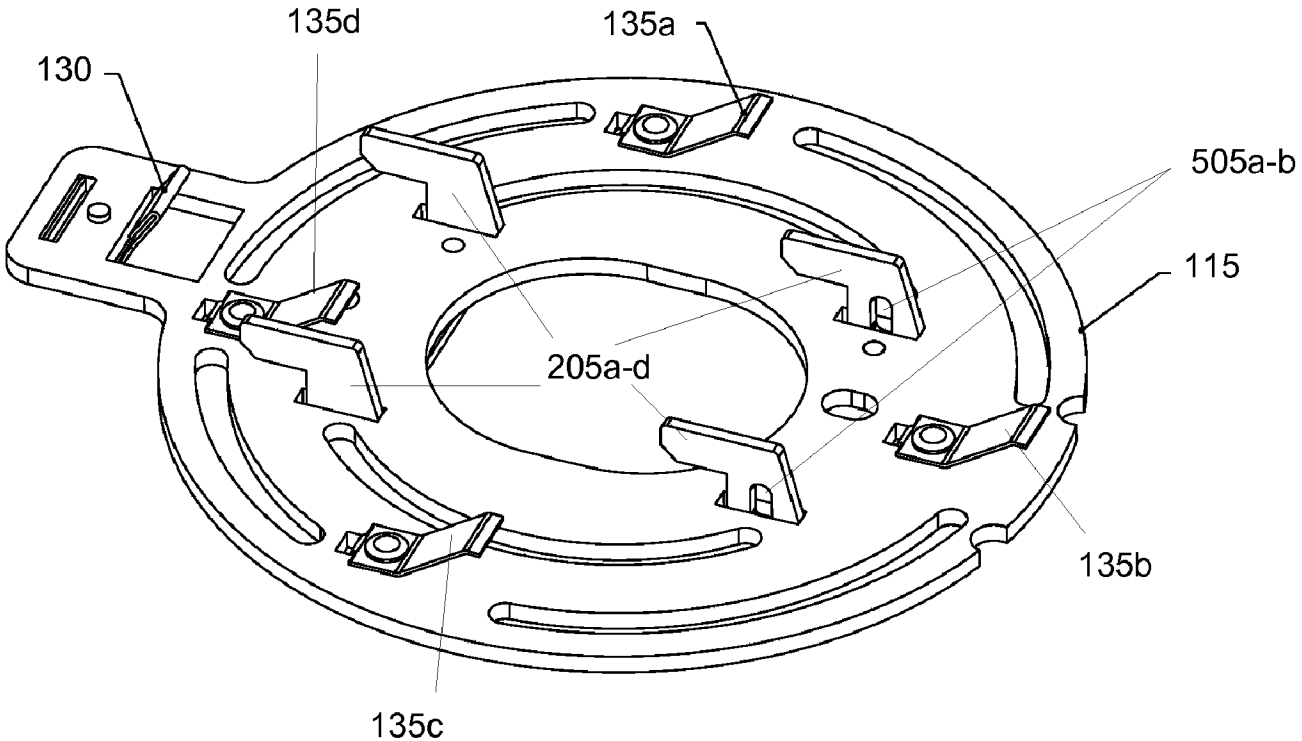
FIG. 5 is a perspective view of a close-up of an underside of the universal bracket, according to an exemplary embodiment of the invention.
Figure 6:
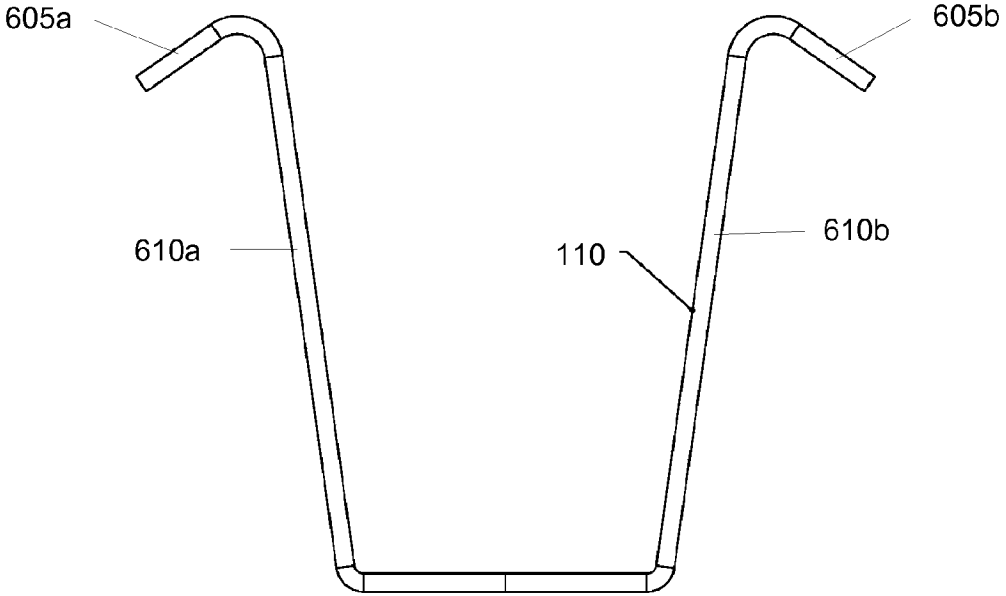
FIG. 6 is an elevation view of a hanging hook for use with a quick-mount universal bracket, according to an exemplary embodiment of the invention.
Figure 7:
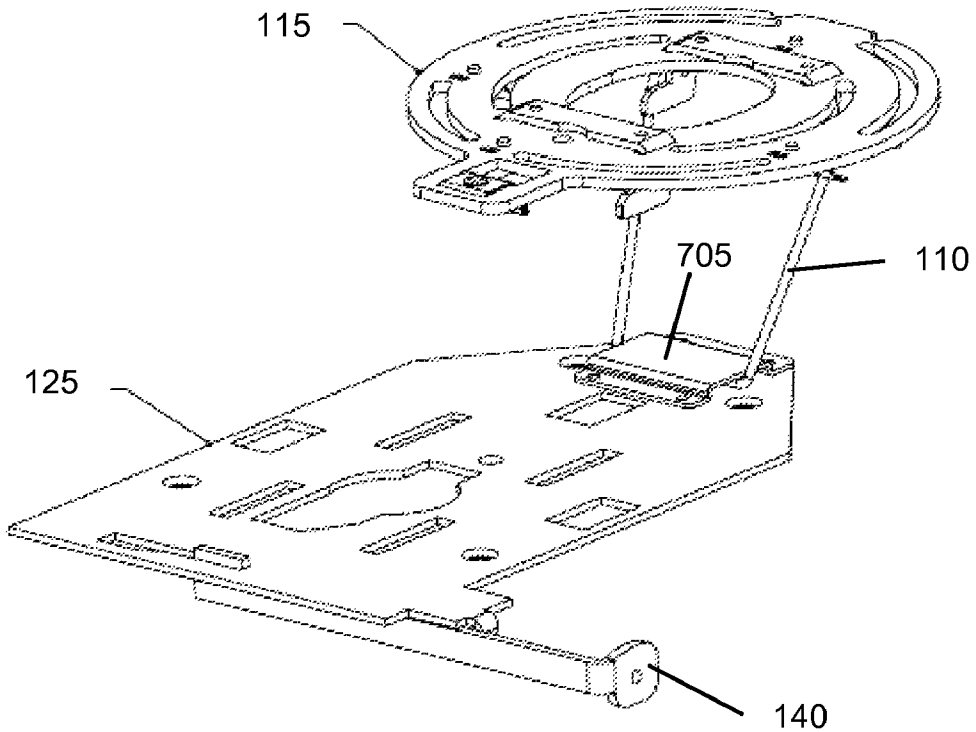
FIG. 7 is a perspective view of the interplay of the universal bracket and a top mounting plate, according to an exemplary embodiment of the invention.
Figure 8:
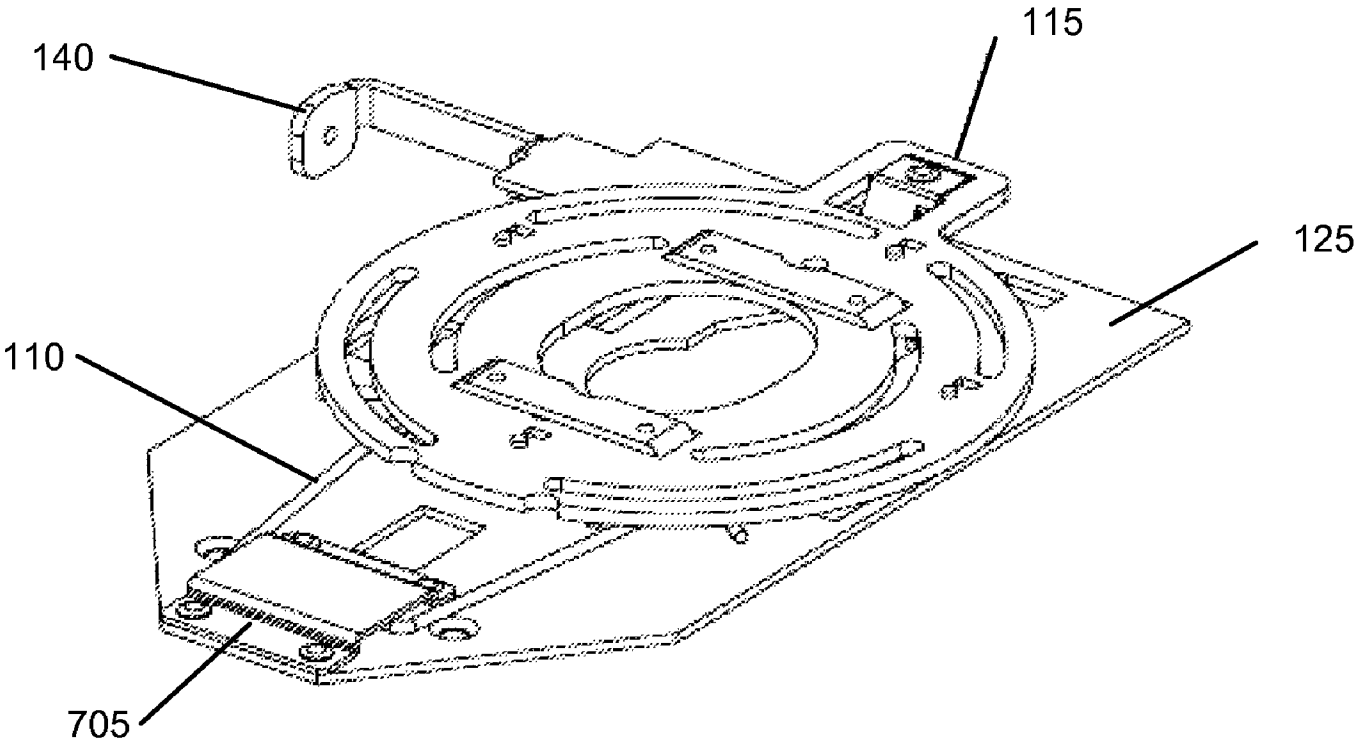
FIG. 8 is a perspective view of a universal bracket interlocked with a top mounting plate, according to an exemplary embodiment of the invention.

Turning now to the drawings, in which like numerals indicate like elements throughout the several figures, exemplary embodiments of the invention are described in detail. FIG. 1 is a perspective view of a luminaire system using a quick-mount universal bracket 100, according to an exemplary embodiment of the invention. FIG. 2 is a partial perspective view of the luminaire system using the quick-mount universal bracket 100, according to an exemplary embodiment of the invention. FIG. 3 is an elevation view of the quick-mount universal bracket system 100, according to an exemplary embodiment of the invention. FIG. 4 is a perspective view of the interplay of the universal bracket and a top mounting plate, according to an exemplary embodiment of the invention. FIG. 5 is a perspective view of a close-up of an underside of the universal bracket, according to an exemplary embodiment of the invention. FIG. 6 is an elevation view of a hanging hook for use with a quick-mount universal bracket, according to an exemplary embodiment of the invention. FIG. 7 is a perspective view of the interplay of the universal bracket and a top mounting plate, according to an exemplary embodiment of the invention. And FIG. 8 is a perspective view of a universal bracket interlocked with a top mounting plate, according to an exemplary embodiment of the invention.

Referring to FIGS. 1 through 8, a system 100 for using a quick-mount universal bracket includes a housing 105, a hanging hook 110, and a universal bracket 115. In one exemplary embodiment, the housing 105 includes electrical components (not shown) disposed generally in the top portion of the housing 105, one or more lamp sockets (not shown) electrically coupled to the electrical components, and reflectors, diffusers, and/or transparent covers coupled to the housing 105. As illustrated, the universal bracket 115 attaches along one side to an electrical junction box 120. In one exemplary embodiment, the junction box 120 is conventionally affixed to a structure, such as a ceiling. The housing 105 further includes a top mounting plate 125 that is configured to engage the universal mounting bracket 115 so as to securely affix the housing 105 to the universal bracket 115. In one exemplary embodiment, the top mounting plate 125 is positioned along the top surface of the housing 105. In an exemplary embodiment, the universal bracket 115 also includes a locking spring 130 and a reinforced spring 135. The locking spring 130, along with locking the housing 105 in place, also assists in keeping the housing 105 from vibrating from side to side. The reinforced spring 135 applies pressure against the top mounting plate 125 and also assists with reducing vibrations when the housing 105 is secured to the universal bracket 115.

According to an exemplary embodiment, the housing 105 also includes a release button 140 disposed along the top portion of the housing and facing out therefrom such that the button 140 can be activated when the housing 105 is coupled to the bracket 115. The release button 140 interacts with the locking spring 130 to disengage the housing 105 from the universal bracket 115. Specifically, the release button 140 swivels a latch 305 (illustrated in FIG. 3) away from the locking spring 130, thereby disengaging the top mounting plate 125 of the housing 105 from the universal mounting bracket 115. In this manner, the housing 105 is removed from the universal bracket 115 without requiring the use of tools. Further, in an exemplary embodiment, the hooks 605*a-b* of the hanging hook 110 are clipped into clips 505*a-b* in the universal bracket 115 and connected to the top mounting plate 125 such that the housing 105 hangs from the universal bracket 115 and swivels about an axis in-line with the hooks 605*a-b*. This allows a user of the system 100 to easily remove the housing 105 from the universal bracket 115 by simply pressing the release button 140 and swiveling the housing 105 away from the universal bracket 115. FIG. 7 illustrates how the hanging hook 110 can connect the universal bracket 115 to the top mounting plate 125.

According to one exemplary embodiment, the hanging hook 110 is substantially a u-shaped hook with opposite facing attachment arms 610*a-b*, as illustrated in FIG. 6, which can easily be attached and removed from the clips 505*a-b* in the universal bracket 115 by a user squeezing each arm 610*a-b* towards one another thereby reducing the distance between the two arms 610*a-b* to an amount that is less than the distance between the two clips 505*a-b* in the universal bracket 115, to "unhook" the hanging hook 110 from the universal bracket 115. Accordingly, the hanging hook 110 can be unclipped from the universal bracket 115 to allow the housing 105 to be completely removed from the system 100 in order to replace or repair a bulb or other component of the housing 105.

As shown in FIG. 2, the locking spring 130 and reinforced spring 135 are preferably located on and/or extend out to along the underside of the universal bracket 115. One or more slide hooks 205 are also be located on the bottom side of the universal bracket 115 to hold the housing 105 in place. For example, when the housing 105 rotates upward, the slide hooks 205, locking spring 130, and reinforced spring 135, engage one or more aperture holes 405*a-d* (of FIG. 4) of the top mounting plate. Therefore, the hooks 205 hold the housing 105 in place against the universal bracket 115, the locking spring 130 secures the housing 105 in place and keeps it from rattling from side-to-side, and the reinforced spring 135 provides pressure against the top-mounting plate 125 to help prevent rattling between the universal bracket 110 and the housing 105.

Turning to FIGS. 3 and 7, the hanging hook 110 is removably affixed between the top mounting plate 125 of the housing 105 and universal bracket 115 to allow the housing 105 to swivel when released from the universal bracket 115 and to keep the housing 105 from falling when it is released from the universal bracket 115. As illustrated, a bracket 705 may attach the hanging hook 110 to the top mounting plate 125. The hanging hook 110 acts as a guide to move the housing 105 into position so that it can be placed on the slide hooks 205, so pressure can be applied against the reinforced spring 135, and so it can be locked into position by the locking spring 130. According to an exemplary embodiment, the locking spring 130 and reinforced spring 135 can be made of any material, including, but not limited to, metal or plastic. The other components of the quick mount universal bracket system 100 may likewise be made of any material, including metal or plastic.

Also, as shown in FIG. 3, the latch 305 is connected to the release button 140, therefore allowing the mounting plate 125 (and housing 105) to be removed from the universal bracket 115 without the need for tools. Specifically, the latch 305 interacts with the locking spring 130 (by latching on to a ridge on the top mounting plate 125) to secure the top mounting plate 125 into position with the universal bracket 115. Then, when a user wishes to remove the housing 105 or mounting plate 125, he or she can press the release button 140 that mechanically moves the latch 305 to apply pressure against the locking spring 130 and unhook it from the mounting plate 125.

Referencing FIG. 4, the universal bracket 115 includes one or more reinforced springs 135 that provide downward tension against the top mounting plate 125 when it is placed into position against the universal bracket 115. The slide hooks 205*a-d* can be engaged with corresponding holes 405*a-d* on the top mounting plate 125, which allow the housing 105 to remain in its mounted position. Further, the locking spring 130 is, according to an exemplary embodiment, mechanically engaged with the latch 305 (not shown in FIG. 4). The latch 305 is connected to the release button 140 when the top mounting plate 125 is mounted against the universal bracket 115. This way, when the release button 140 is pressed, the locking spring 130 is disengaged from the top mounting plate 125, thereby allowing the housing 105 to be removed from its mounted position (i.e., the housing 105 can be rotated or slid away from a latch on the universal bracket 115 when the release button 140 is pressed).

As shown in FIG. 5, one or more reinforced springs 135*a-d* provide downward tension against the top mounting plate 125 (of FIG. 4), and the locking spring 130 provides side-to-side tension against the top mounting plate 125. In this manner, the quick-mount universal bracket system 100 of the present invention exhibits decreased rattling over conventional luminaries.

As illustrated in FIG. 8, the system is designed such that the top mounting plate 125 and universal bracket 115 can be securely attached to reduce vibrations and eliminate the need for tools during installation. As discussed, reinforced springs 135 and a locking spring 130 assist in retaining the top mounting plate securely against the universal bracket. Further, when the user is ready to remove the top mounting plate 125 (and, hence, the connected housing—not illustrated), the user can simply press the release button 140 and allow the top mounting plate 125 to safely rotate away from the universal bracket 115 through the use of the hanging hook 110.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A luminaire system, comprising a luminaire housing, comprising:

a top mounting plate rotatable from an open position to a closed position;

a release button assembly comprising:

a release button configured to move from a first position to a second position when depressed;

a latch mechanically coupled to the release button and configured to move from a third position to a fourth position when the release button is depressed;

a longitudinal member have a first end and a distal second end;

wherein the release button is disposed along the first end and the latch is mechanically coupled to the distal second end;

wherein the release button assembly is disposed below the top mounting plate and the latch extends up into an elongated slot in the top mounting plate; and wherein the release button assembly is manually adjustable from an exterior of the housing when the top mounting plate is in the closed position;

a bracket, comprising:

a first surface and a second surface, said first surface disposed against a mounting surface;

a locking spring extending out from the second surface and configured to releasably couple to the latch when the mounting plate is in the closed position; and a hanging hook comprising a first end rotatably coupled to the bracket and a distal second end rotatably coupled to the top mounting plate;

wherein in the fourth position the latch ceases contact with the locking spring.

2. The luminaire system of claim 1, wherein the locking spring is configured to releasably couple to the top mounting plate when the top mounting plate is coupled to the bracket.

3. The luminaire system of claim 1, wherein depressing the release button disengages the locking spring from the top mounting plate, allowing the top mounting plate to swivel away from the bracket on the hanging hook.

4. The luminaire system of claim 1, wherein the housing supports a light fixture.

5. The luminaire system of claim 1, wherein the housing is disengaged from the bracket by manually depressing the release button.

6. A luminaire system of claim 1, further comprising:

a reinforced spring, extending downward from the second surface of the bracket and configured to contact a top surface of the top mounting plate and apply a downward force on the top mounting plate in the closed position.

7. The luminaire system of claim 1, further comprising:

a plurality of slide hooks extending down from the second surface of the bracket; and a plurality of apertures disposed through the top mounting plate;

wherein at least a portion of each slide hook extends through one of the apertures in the closed position.

8. The luminaire system of claim 1, wherein the top mounting plate is de-coupled from the bracket by depressing the release button and moving the latch from the third position to a the fourth position.

9. The luminaire housing of claim 1, wherein the latch, one or more holes, and release button are disposed along a top side of the housing.

10. The luminaire housing of claim 1, wherein in the fourth position the latch ceases contact with the locking spring and decouples from the locking spring to disengage the top mounting bracket from the bracket.

11. The luminaire housing of claim 1, wherein the top mounting plate further comprises:

a bracket coupled to a top side of the top mounting plate the bracket comprising:

a first panel and a second panel coupled to the top side of the top mounting plate; and a raised panel coupled along one end to the first panel and along an opposing end to the second panel and defining a channel between the raised panel and the top side of the top mounting plate, wherein the second end of the hook extends through the channel.

12. The luminaire housing of claim 11, wherein the hanging hook comprises a u-shaped device comprising a plurality of hooks disposed along the first end and coupled to the bracket.

13. The luminaire system of claim 1, wherein the bracket further comprises a plurality of reinforcing springs extending out from the second surface and applying downward pressure to the top mounting plate when the top mounting plate is coupled to the bracket in the closed position.

14. The luminaire system of claim 1, wherein the bracket further comprises a plurality of slide hooks extending down from the second surface of the bracket;

wherein the top mounting plate comprises a plurality of elongated apertures disposed through the top mounting plate; and wherein at least a portion of each of the plurality of slide hooks extends through at least one of the corresponding elongated apertures when the top mounting plate is coupled to the bracket.

15. The luminaire system of claim 1, wherein the bracket comprises a plurality of reinforcing springs, each reinforcing spring extending down from the second surface of the bracket and applying a downward pressure to the top mounting plate when the top mounting plate is coupled to the bracket in the closed position.

* * * * *